US010336115B2

(12) United States Patent
Yoda et al.

(10) Patent No.: US 10,336,115 B2
(45) Date of Patent: Jul. 2, 2019

(54) TRANSFER SHEET

(71) Applicant: Dai Nippon Printing Co., Ltd., Tokyo (JP)

(72) Inventors: Shinya Yoda, Tokyo (JP); Emi Matsuba, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/758,106

(22) PCT Filed: Sep. 9, 2016

(86) PCT No.: PCT/JP2016/076694

§ 371 (c)(1),
(2) Date: Mar. 7, 2018

(87) PCT Pub. No.: WO2017/043650

PCT Pub. Date: Mar. 16, 2017

(65) Prior Publication Data

US 2018/0244095 A1 Aug. 30, 2018

(30) Foreign Application Priority Data

Sep. 11, 2015 (JP) ..... 2015-179768

(51) Int. Cl.
*B41M 5/382* (2006.01)
*B41M 5/395* (2006.01)
(Continued)

(52) U.S. Cl.
CPC ..... *B41M 5/38214* (2013.01); *B41M 5/382* (2013.01); *B41M 5/395* (2013.01);
(Continued)

(58) Field of Classification Search
CPC .... B41M 5/382; B41M 5/38214; B41M 5/42; B41M 5/44; B41M 2205/06
(Continued)

(56) References Cited

U.S. PATENT DOCUMENTS 5,538,831 A 7/1996 Oshima et al.
5,885,393 A 3/1999 Mano et al.
(Continued)

FOREIGN PATENT DOCUMENTS

CN 1167685 A 12/1997
JP H03-038383 A1 2/1991
(Continued)

OTHER PUBLICATIONS

English translation of International Preliminary Report on Patentability (Chapter II) (Application No. PCT/JP2016/076694) dated Mar. 15, 2018, 5 pages.
(Continued)

*Primary Examiner* — Gerard Higgins
(74) *Attorney, Agent, or Firm* — Burr & Brown, PLLC

(57) ABSTRACT

SOLVING MEANS The main challenge thereof is to provide a transfer sheet that allows printing with a high printing density, which never causes a blur and a crushing of an image.
SOLUTION There is provided a transfer sheet comprising a substrate, as well as a releasing layer and a hot melt colored layer in this order on the substrate, the hot melt colored layer comprising, as a binder resin, a (meth)acrylic resin having a glass transition temperature of not less than 75° C., and a colorant.

11 Claims, 1 Drawing Sheet

(51) Int. Cl.
*B41M 5/40* (2006.01)
*B41M 5/42* (2006.01)
*B41M 5/44* (2006.01)

(52) U.S. Cl.
CPC ..... *B41M 5/40* (2013.01); *B41M 5/42* (2013.01); *B41M 5/44* (2013.01)

(58) Field of Classification Search
USPC ..... 428/32.81
See application file for complete search history.

(56) References Cited

U.S. PATENT DOCUMENTS

| | | | | |
|---|---|---|---|---|
| 2001/0016559 | A1* | 8/2001 | Nakano | B41M 5/345 503/227 |
| 2003/0179274 | A1 | 9/2003 | Morizumi et al. | |

FOREIGN PATENT DOCUMENTS

| | | | |
|---|---|---|---|
| JP | H07-314932 | A1 | 12/1995 |
| JP | H09-099656 | A1 | 4/1997 |
| JP | H09-292686 | A1 | 11/1997 |
| JP | 11-042864 | A | 2/1999 |
| JP | 2000-108524 | A1 | 4/2000 |
| JP | 2001-260542 | A1 | 9/2001 |
| JP | 2002-230738 | A1 | 8/2002 |
| JP | 2003-266956 | A1 | 9/2003 |
| JP | 2005-103990 | A1 | 4/2005 |
| JP | 2011-073383 | A1 | 4/2011 |
| JP | 2011-201180 | A1 | 10/2011 |

OTHER PUBLICATIONS

International Search Report and Written Opinion (Application No. PCT/JP2016/076694) dated Oct. 11, 2016.

Chinese Office Action (Application 201680051542.9) dated Jan. 9, 2019 (with English translation).

Korean Office Action (with English translation), Korean Application No. 10-2018-7006420, dated Feb. 26, 2019 (9 pages).

* cited by examiner

TRANSFER SHEET

BACKGROUND OF THE INVENTION

Field of the Invention

The present invention relates to a transfer sheet, and more particularly to a transfer sheet comprising a substrate, and a hot melt colored layer comprising a colorant and a (meth) acrylic resin on the substrate.

Background Art

Currently, a heat transfer recording method is widely used as a simple printing method. Since the heat transfer recording method can easily create various images, it has been used for creating printed materials in which the number of printed sheets may be relatively few, e.g., an identification card such as a personal status certificate, as well as for business photos, or a personal computer printer and a video printer, for example.

Transfer sheets used in a heat transfer recording system are classified broadly into a so-called melt transfer-type transfer sheet in which a hot melt colored layer containing a colorant is melted and softened by heating to be transcribed and transitioned to a transfer body, i.e., an image-receiving sheet; and a so-called sublimation-type transfer sheet, in which a dye in a dye layer is sublimated by heating to be transitioned to an image-receiving sheet. Here, a melt transfer-type heat transfer sheet will be used when creating identity documents (ID) such as a personal status certificate, especially when forming monotonous images such as letters or numbers.

When forming monotonous images such as letters or numbers using a melt transfer-type heat transfer sheet, the occurrence of a blur and a crushing of an image is a problem. In order to solve this problem, in the Patent Document 1, a transfer sheet that comprises a substrate, as well as a colored layer comprising an acrylic resin, a polyester resin and a colorant is proposed.

Unfortunately, the transfer sheet disclosed in the Patent Document 1 has an inadequate performance in preventing a blur and a crushing of an image, and thus there is still a room for improvement.

PRIOR ART DOCUMENTS

Patent Document

Patent Document 1 Japanese Unexamined Patent Application Publication No. 2011-201180.

SUMMARY OF THE INVENTION

Problem to be Solved by the Invention

The present invention has been achieved in the light of the above-mentioned background art, the main challenge thereof is to provide a transfer sheet having a high printing stability, which never causes a blur and a crushing of an image.

Means for Solving the Problem

In order to solve the above-mentioned problem, the present inventors conducted intensive studies, and consequently have found that the above-mentioned problem could be solved by using a transfer sheet comprising a substrate, a releasing layer, as well as a hot melt colored layer comprising a (meth)acrylic resin as a binder resin having a glass transition temperature of not less than 75° C., and a colorant. The present invention has been completed based on such findings.

That is to say, according to one aspect of the present invention, there is provided a transfer sheet comprising a substrate, and a releasing layer and a hot melt colored layer in this order on the substrate, the hot melt colored layer comprising, as a binder resin, a (meth)acrylic resin having a glass transition temperature of not less than 75° C., and a colorant.

In the above-mentioned aspect of the present invention, a releasing layer preferably comprises a vinyl chloride-vinyl acetate resin.

In the above-mentioned aspect of the present invention, the content of a (meth)acrylic resin in a hot melt colored layer is preferably not less than 50% by mass.

In the above-mentioned aspect of the present invention, the weight average molecular weight of a (meth)acrylic resin is preferably 20000 or more and 100000 or less.

In the above-mentioned aspect of the present invention, a preferable transfer sheet further comprises a mold release layer between a substrate and a releasing layer.

In the above-mentioned aspect of the present invention, the ratio of the colorant content to the (meth)acrylic resin content (i.e., the colorant content/the (meth)acrylic resin content) in a hot melt colored layer is preferably 1.0 or more and 3.5 or less by mass.

In the above-mentioned aspect of the present invention, a preferable transfer sheet further comprises a dye layer on a substrate.

Effects of the Invention

According to the present invention, a transfer sheet having a high printing stability, which never causes a blur and a crushing of an image due to printing an image is to be provided.

DETAILED DESCRIPTION OF THE INVENTION

Description of Embodiments

As used herein, "part", "%", "ratio", and the like which indicate a blending ratio is by mass unless otherwise specified.

<Transfer Sheets>

A transfer sheet according to the present invention comprising a substrate, as well as a releasing layer and a hot melt colored layer in this order on the substrate, may further comprise a mold release layer between the substrate and the releasing layer, and may further comprise a back layer on the surface opposite to the surface of the hot melt colored layer formed thereon. The layer configuration of a transfer sheet according to the present invention will now be described with reference to the drawings.

Figure 1:
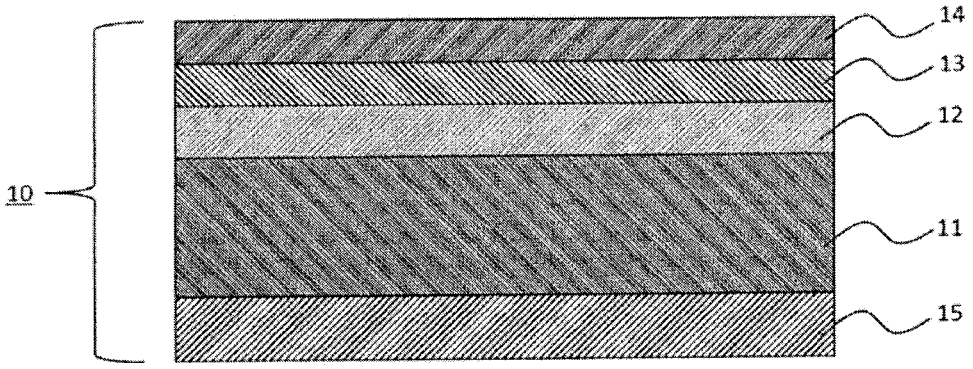
FIG. 1 is a schematic cross-sectional view showing one embodiment of a transfer sheet according to the present invention.

FIG. 1 is a schematic cross-sectional view of one embodiment of a transfer sheet according to the present invention. The transfer sheet 10 shown in FIG. 1 comprises a substrate 11, a mold release layer 12, a releasing layer 13 and a hot melt colored layer 14 in this order on the substrate 11, and further comprises a back layer 15 on the surface opposite to the mold release layer 12 of the substrate 11.

Figure 2:
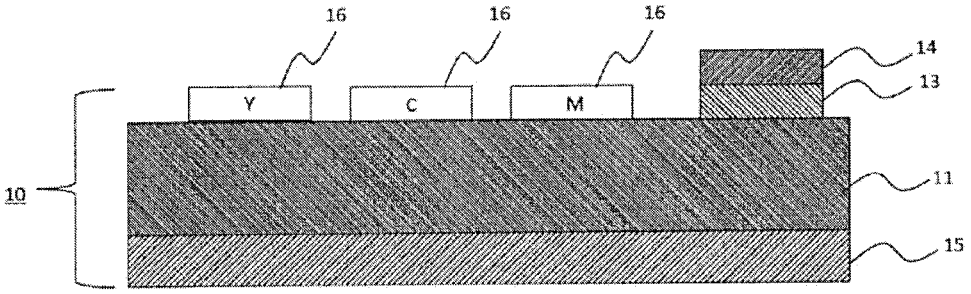
FIG. 2 is a schematic cross-sectional view showing one embodiment of a transfer sheet according to the present invention.

In one embodiment, as shown in FIG. 2, a transfer sheet 10 according to the present invention may further comprise a dye layer 16 on the substrate 11. The dye layer 16 may be provided sequentially with respect to the surface of the releasing layer 13 (see FIG. 2); and may be provided sequentially with respect to the surface of the mold release layer 12 if the mold release layer 12 is provided between the substrate 11 and the releasing layer 13 (not shown).

Each layer composing a transfer sheet according to the present invention will now be described in detail.

<A Substrate>

In the present invention, a substrate is preferably a material that assumes a role of holding a hot melt colored layer, and that is provided with a mechanical strength the degree of which is that there is no handling trouble even in a heated state when heated during heat transfer. Materials for such a substrate include polyethylene terephthalate (PET) films, 1,4-polycyclohexylenedimethylene terephthalate films, polyethylene naphthalate films, polyphenylene sulfide films, polystyrene films, polypropylene films, polysulfone films, aramid films, polycarbonate films, polyvinyl alcohol films; cellulose derivatives such as, e.g., cellophane and cellulose acetate; polyethylene films, polyvinyl chloride films, nylon films, polyimide films, ionomer films, and the like. Also, a substrate preferably has a thickness of 2 μm or more and 20 μm or less; more preferably 4 μm or more and 10 μm or less.

A substrate having a surface subjected to an easy adhesion treatment can be employed. Easy adhesion treatments include, e.g., a treatment for forming an easy-adhesive layer between a substrate and the hot melt colored layer described below, for example. Such an easy-adhesive layer preferably comprises, for example, an aqueous acryl, an aqueous polyester and an aqueous epoxy compound. An aqueous acryl is a water-soluble or a water-dispersable acrylic resin, preferably having alkyl acrylate or alkyl methacrylate as a principal component, and preferably copolymerized so that such a component is not less than 30 mole % and not more than 90 mole %. An aqueous polyester refers to a water-soluble or a water-dispersible polyester resin; and as components that constitute such a polyester resin, polyvalent carboxylic acid and polyvalent hydroxy compounds can be exemplified. An aqueous epoxy compound is a compound containing a water-soluble or water-dispersable epoxide group, preferably a water-soluble epoxide group, wherein the aqueous epoxy compound contains at least one or more, and preferably two or more epoxide groups in a molecule. Such aqueous epoxy compounds include glycols, polyethers, glycidyl ethers of polyols, glycidyl ethers of carboxylic acids, glycidyl-substituted amines, and the like, whereas preferred are glycidyl ethers. As an easy adhesion treatment, a method for forming an easy-adhesive coating film on the surface of a substrate is preferably employed.

Also, other easy adhesion treatments include subjecting the surface of a substrate to, e.g., corona discharge treatment, plasma treatment, ozone treatment, frame treatment, preheat treatment, dust removal treatment, vapor deposition treatment, alkali treatment, antistatic layer-imparting treatment, and the like.

<A Releasing Layer>

In the present invention, a releasing layer is a layer provided so as to allow a hot melt colored layer to be readily exfoliated from a substrate when thermally transcribed, and thus the releasing layer is transcribed along with the hot melt colored layer. A releasing layer can be provided between a substrate and a hot melt colored layer.

A releasing layer preferably comprises a vinyl chloride-vinyl acetate resin as a binder resin. A releasing layer, by comprising a vinyl chloride-vinyl acetate resin, can improve the ability to be released from a heat transfer sheet. Also, even when using an intermediate transfer recording medium, the performance of releasing from a heat transfer sheet during the primary transfer will be compatible with the adhesiveness to each transfer body during the retransfer.

Also, the content of a vinyl chloride-vinyl acetate resin in a releasing layer is preferably not less than 50% by mass; and more preferably not less than 80% by mass. If the content of a vinyl chloride-vinyl acetate resin is within the above-mentioned range, a transfer sheet that suppresses occurrence of a crushing and a blur in an image made by printing can be obtained. Also, the content of a vinyl chloride-vinyl acetate resin is preferably 100% by mass or less.

It is to be noted that, in the present invention, vinyl chloride-vinyl acetate resins include (1) a copolymer of vinyl chloride and vinyl acetate, or derivatives thereof; and (2) a copolymer of vinyl chloride, vinyl acetate and other monomers.

In addition to a vinyl chloride-vinyl acetate resin, a releasing layer may comprise, as a binder resin, e.g., a polyester resin, a (meth)acrylic resin, a urethane resin, an acetal resin, a polyamide resin, a melamine resin, a polyol resin, a cellulose resin, and the like.

A releasing layer may further comprise an additive such as an exfoliant. A silicone oil and/or a wax component are used as an exfoliant. By adding exfoliants such as a silicone oil and a wax component to a releasing layer, a transfer sheet that suppresses a crushing and a blur in an image made by printing can be obtained. Silicone oils include an amino-modified silicone, an epoxy-modified silicone, an aralkyl-modified silicone, an epoxy-aralkyl-modified silicone, an alcohol-modified silicone, a vinyl-modified silicone, a urethane-modified silicone and the like, and an epoxy-modified silicone oil is preferably employed. Wax components include, for example, various waxes such as microcrystalline waxes, carnauba waxes, paraffin waxes, Fischer Tropsch waxes, various low molecular weight polyethylenes, tree waxes, beeswaxes, whale waxes, insect waxes, wool waxes, shellac waxes, candelilla waxes, petrolatums, partially-modified waxes, fatty acid esters, fatty acid amides, and the like, and polyethylene waxes are preferably employed.

Methods for forming a releasing layer are not limited to particular methods, whereas such a layer can be formed by a conventionally known coating method. This layer can be formed by, for example, adding the above-mentioned binder resin, and optionally an additive such as an exfoliant to a suitable solvent; dissolving or dispersing each ingredient in the mixture to prepare an application liquid; and then this application liquid is applied onto a substrate or a mold release layer using a known means such as gravure coating method, roll coating method, comma coating method, gravure printing method, screen printing method, and gravure reverse roll coating method, and the like; and dried. Also, the dry coating amount of an application liquid is preferably 0.2 $g/m^2$ or more and 2.0 $g/m^2$ or less; and more preferably 0.4 $g/m^2$ or more and 1.0 $g/m^2$ or less.

<A Hot Melt Colored Layer>

In the present invention, a hot melt colored layer is provided on a substrate of a transfer sheet; and is transcribed onto a transfer body or a receptive layer of an intermediate transfer recording medium, by overlapping a transfer sheet and a transfer body or an intermediate transfer recording medium, and by heating the back side of a substrate (the side of a substrate where no hot melt colored layer is provided) using a conventionally known heating means such as, e.g., a thermal head of a heat transfer printer. Thus, by transcribing a hot melt colored layer onto a transfer body or a receptive layer of an intermediate transfer recording medium, images such as, e.g., letters or numbers can be formed.

A hot melt colored layer comprises a colorant, and a (meth)acrylic resin as a binder resin. A hot melt colored layer, by comprising a (meth)acrylic resin, can improve the transferability of a transfer sheet.

It is to be noted that, in the present invention, "(meth) acrylic" includes both "acrylic" and "methacrylic". Also, (meth)acrylic resins include (1) a polymer of monomers of acrylic acids or methacrylic acids, or derivatives thereof; (2) a polymer of monomers of acrylic acid esters or methacrylic acid esters, or derivatives thereof; (3) a copolymer of monomers of acrylic acids or methacrylic acids and other monomers, or derivatives thereof; and (4) a copolymer of monomers of acrylic acid esters or methacrylic acid esters, and other monomers, or derivatives thereof.

Monomers of acrylic acid esters or methacrylic acid esters can include, e.g., alkyl acrylates, alkyl methacrylates, methyl acrylates, methyl methacrylates, ethyl acrylates, ethyl methacrylates, butyl acrylates, butylmethacrylates, lauryl acrylates, and lauryl methacrylates, for example.

Other monomers include, e.g., aromatic hydrocarbons, aryl group-containing compounds, amide group-containing compounds and vinyl chloride, for example, and more particularly, styrene, benzil styrene, phenoxy ethyl methacrylates, acrylic amides, methacrylamides, and the like.

(Meth)acrylic resins include poly(meta)acrylates, polymethyl(meth)acrylates, poly(meth)acrylamides, styrene-acrylic copolymers, and the like. Among them, particularly preferred are polymethyl(meth)acrylates, which better preserve heat resistance, rub fastness and transparency.

The glass transition temperature (Tg) of a (meth)acrylic resin is not less than 75° C.; and more preferably not less than 95° C. Assuming the Tg of a (meth)acrylic resin to be within the above-mentioned numerical range, allows the heat resistance of a hot melt colored layer to be improved, and this can improve the printing stability. Also, the Tg is preferably 110° C. or less; and more preferably 105° C. or less. It is to be noted that the Tg is determined by measuring a change in a calorific value by means of DSC (differential scanning calorimetry) (DSC method).

The content of a (meth)acrylic resin relative to the total solid content of a binder resin in a hot melt colored layer is preferably not less than 50% by mass; and more preferably not less than 80% by mass. By assuming the content of a (meth)acrylic resin to be within the above-mentioned numerical range, the transferability can be stabilized under various printing conditions. Also, the content of a (meth) acrylic resin in a binder resin is preferably 100% by mass or less.

The weight average molecular weight (Mw) of a (meth) acrylic resin is preferably 20000 or more and 100000 or less; more preferably 30000 or more and 90000 or less; and even more preferably 40000 or more and 85000 or less. By assuming the Mw of a (meth)acrylic resin to be within the above-mentioned numerical range, occurrences of a blur and a crushing of an image can be prevented. It is to be noted that the Mw is the molecular weight in terms of polystyrene measured by means of gel permeation chromatography (GPC).

Also, if a hot melt colored layer comprises two or more (meth)acrylic resins, the average Mw therebetween will be 20000 or more and 100000 or less; more preferably 30000 or more and 90000 or less; and even more preferably 40000 or more and 85000 or less. For example, if a hot melt colored layer comprises an acrylic resin having an Mw of 40000 and another acrylic resin having an Mw of 95000 at a mass ratio of 7:3, the average Mw therebetween amounts to 56500 ($40000\times0.7+95000\times0.3$).

Furthermore, if a hot melt colored layer contains resins other than a (meth)acrylic resin, resin components contained in the hot melt colored layer preferably have an average Mw of 20000 or more and 100000 or less; more preferably 30000 or more and 90000 or less; even more preferably 40000 or more and 85000 or less.

A hot melt colored layer, to the extent that it does not damage a property thereof, may comprise, as a binder resin, a (meth)acrylic resin, as well as vinyl resins such as a polyvinyl alcohol resin, a polyvinyl acetate resin, a vinyl chloride-vinyl acetate resin, a polyvinyl butyral resin and a polyvinyl acetal resin, polyvinyl pyrrolidone; polyester resins such as a polyethylene terephthalate resin and a polyethylene naphthalate resin; urethane resins such as a polyurethane acrylate; cellulosic resins such as an ethyl cellulose resin, a hydroxyethyl cellulose resin, an ethyl hydroxyethyl cellulose resin, a methyl cellulose resin, a cellulose acetate resin; polyamide resins such as a polyamide resin, an aromatic polyamide resin, a polyamideimide resin; an acetal resin, and a polycarbonate resin, for example. Among the above-mentioned binder resins, in terms of the ability to suppress occurrence of a blur in an image made by printing, and a further improved transferability, preferred is a vinyl chloride-vinyl acetate resin.

As a colorant, a conventionally known colorant can be employed, whereas a preferable colorant has a good property as a photographic material, for example, a colorant having an adequate staining concentration, and which is not subjected to discoloration due to the light, heat, temperature or the like. Also, a colorant may be a substance that develops color by heating, or a substance that develops color by contacting with a component applied to the surface of a transfer body. A preferable colorant exhibits at least one color selected from the group consisting of black, white, silver, cyan, magenta, yellow, red, green, and blue. As colorants, preferably employed are, for example, carbon black for black; titanium oxide for white; an inorganic material such as aluminum for silver; and the respective pigments described in the C.I. Pigment for cyan, magenta, yellow, red, green and blue.

The colorant content in a hot melt colored layer is preferably 20% by mass or more and 90% by mass or less; more preferably 40% by mass or more and 80% by mass or less.

Methods for forming a hot melt colored layer are not limited to particular methods, whereas such a layer can be formed by a conventionally known coating method. This layer can be formed by, for example, adding the above-mentioned colorant and a (meth)acrylic resin to a suitable solvent; dissolving or dispersing each ingredient in the mixture to prepare an application liquid; and then using a known means such as gravure coating method, roll coating method, comma coating method, gravure printing method, screen printing method, and gravure reverse roll coating method, and the like, this application liquid is applied onto a substrate, and dried. Also, the dry coating amount of an application liquid is preferably 0.5 $g/m^2$ or more and 10 $g/m^2$ or less; and more preferably 0.8 $g/m^2$ or more and 5 $g/m^2$ or less.

The ratio of the colorant content and the acrylic resin content (i.e., a colorant content/acrylic resin content) in a hot melt colored layer is preferably not less than 0.8; and more preferably 3.5 or less by mass. A hot melt colored layer containing a colorant and acrylic resin at such a ratio allows printing with a high density, which never causes a blur and a crushing of an image.

<A Mold Release Layer>

In the present invention, a mold release layer is optionally provided so as to allow a hot melt colored layer to be readily exfoliated from a substrate during a heat transfer, and remains on the side of a substrate during the heat transfer. A mold release layer can be provided between a substrate and a hot melt colored layer, or between a substrate and a releasing layer.

A mold release layer is preferably formed of ingredients having mold release characteristics, preferably comprising, for example, a binder resin and an additive such as, e.g., a mold release agent. Binder resins include a (meth)acrylic resin, a urethane resin, an acetal resin, a polyamide resin, a melamine resin, a polyol resin, a cellulose resin, and a polyvinyl alcohol, and the like; and a urethane resin and an acetal resin are preferably employed. Mold release agents can include a silicone oil, a phosphoric acid ester-based plasticizer, a fluorine-based compound, a wax, a metallic soap and a filler, for example, and a silicone oil is preferably employed.

Methods for forming a mold release layer are not limited to particular methods, whereas such a layer can be formed by a conventionally known coating method. This layer can be formed by, for example, adding the above-mentioned binder resin, and optionally an additive such as a mold release agent to a suitable solvent; dissolving or dispersing each ingredient in the mixture to prepare an application liquid; and then using a known means such as gravure coating method, roll coating method, comma coating method, gravure printing method, screen printing method, and gravure reverse roll coating method, and the like, this application liquid is applied onto a substrate, and dried. Also, the dry coating amount of an application liquid is preferably 0.1 $g/m^2$ or more and 1.0 $g/m^2$ or less; and more preferably 0.2 $g/m^2$ or more and 0.6 $g/m^2$ or less.

<A Back Layer>

In the present invention, a back layer is a layer optionally provided for the purpose of preventing a negative effect such as a sticking or a wrinkle due to heating from the back side of a substrate (the side of a substrate where no hot melt colored layer is provided) at the time of heat transfer. By providing a back layer, a transfer sheet comprising, as a substrate, a plastic film having a poor heat resistance allows heat printing without causing any sticking; this can harness features of a plastic film such as, e.g., toughness, and easy processing.

A back layer preferably comprises a binder resin and an additive such as, e.g., a slip agent. Binder resins used in a back layer include an acrylic resin, a vinyl resin, a polyester resin, a urethane resin, a cellulosic resin, a polyamide resin, an acetal resin, and a polycarbonate resin, and the like. Slip agents include a metallic soap, a wax, a silicone oil, a fatty acid ester, a filler, a talc, and the like.

Methods for forming a back layer are not limited to particular methods, whereas such a layer can be formed by a conventionally known coating method. This layer can be formed by, for example, adding the above-mentioned binder resin, and optionally an additive such as a slip agent to a suitable solvent; dissolving or dispersing each ingredient in the mixture to prepare an application liquid; and then using a known means such as gravure coating method, roll coating method, comma coating method, gravure printing method, screen printing method, and gravure reverse roll coating method, and the like, this application liquid is applied onto a substrate, and dried. Also, the dry coating amount of an application liquid is preferably 0.2 $g/m^2$ or more and 2.0 $g/m^2$ or less; and more preferably 0.4 $g/m^2$ or more and 1.2 $g/m^2$ or less.

<A Dye Layer>

A transfer sheet according to the present invention comprising a substrate may optionally have a dye layer thereon.

The dye layer may be provided sequentially with respect to the surface of the releasing layer; and if a mold release layer is provided between the substrate and the releasing layer, the dye layer may be provided sequentially with respect to the surface of the mold release layer.

A preferable dye layer comprises sublimation dyes, and has adequate coloring concentration, and which is not subjected to discoloration due to the light, heat, temperature or the like.

Sublimation dyes that can be employed include, for example, diaryl methane dyes; triaryl methane dyes; thiazoledyes, merocyanine dyes; pyrazolone dyes; methine dyes; india aniline dyess; azomethine dyes (such as acetophenone azomethine, pyrazolo azomethine, imidazole azomethine, imidazo azomethine and pyridone azomethine); xanthene dyes; oxazine dyes; cyano styrene dyes (such as dicyano styrene, and tricyano styrene); thiazine dyes; azine dyes; acridine dyes; azo dyes (such as benzene azo dyes, pyridone azo, thiophene azo, isothiazole azo, pyrrole azo, pyrazole azo, imidazole azo, thiadiazole azo, triazole azo, and disazo); spiropyran dyes; indolinospiropyran dyes; fluorane dyes; rhodamine lactam dyes; naphthoquinone dyes; anthraquinone dyes; quinophthalone dyes; and the like. More particularly, red dyes such as MSRedG (manufactured by Mitsui Toatsu Chemicals, Inc.), Macrolex Red Violet R (manufactured by Bayer Aktiengesellschaft), CeresRed 7B (manufactured by Bayer Aktiengesellschaft) and Samaron Red F3BS (manufactured by Mitsubishi Chemical Corporation); yellow dyes such as Foron Brilliant Yellow 6GL (manufactured by Clariant Corporation), PTY-52 (manufactured by Mitsubishi Kasei Corp.), Macrolex yellow 6G (manufactured by Bayer Aktiengesellschaft) and the like; blue dyes such as Kayaset Blue 714 (manufactured by Nippon Kayaku Co., Ltd.), WAXOLINE BLUE AP-FW (manufactured by ICI Ltd.), Foron Brilliant blue S-R (manufactured by Sandoz K.K.), MS Blue 100 (manufactured by Mitsui Toatsu Chemicals, Inc.), and C.I. Solvent Blue 22 can be employed.

A dye layer preferably comprises binder resins such as a cellulosic resin, a vinyl resin, a (meth)acrylic resin, a polyurethane resin, a polyamide resin, and a polyester resin. Among the above-mentioned binder resins, in terms of having an excellent heat resistance, dye migration, and the like, preferred are a cellulosic resin, a vinyl resin, a (meth) acrylic resin, a urethane resin and a polyester resin; more preferred is a vinyl resin; and particularly preferred is polyvinyl butyral or polyvinylacetoacetal.

Methods for forming a dye layer include, for example, a method comprising: adding an additive such as a mold release agent to a dye and a binder resin as necessary; then, a dye layer application liquid (a solution or a dispersion) obtained by dissolving or dispersing the mixture in a suitable organic solvent such as toluene or methyl ethyl ketone, or water is applied onto one of the surfaces of a substrate by a forming means such as, e.g., gravure printing method, reverse roll coating method using a gravure plate, roll coater, bar coater, or the like; and dried, to form a dye layer. Also, the dry coating amount of an application liquid is preferably 0.2 g/m$^2$ or more and 1.2 g/m$^2$ or less; and more preferably 0.3 g/m$^2$ or more and 0.6 g/m$^2$ or less.

<A Transfer Body>

Transfer bodies available for transcribing a transfer sheet according to the present invention can include, but not limited to, any one of plain papers, fine papers, tracing papers, plastic films, glasses, metals, ceramics, woods, cloths, and the like.

<Transfer Methods>

A hot melt colored layer can be transcribed to a transfer body using a conventionally known thermal-transfer printer.

Also, this can be accomplished, if a transfer body is difficult to perform direct transfer, by transcribing a hot melt colored layer to a receptive layer of an intermediate transfer recording medium (i.e., primary transfer), and then transcribing the receptive layer of the intermediate transfer recording medium to the transfer body (i.e., retransfer).

A thermal-transfer printer may separately set transfer conditions such as, for example, those for sublimation transfer, for thermal melt transfer, and for protective layer transfer; and this can also be done using a common printer to properly adjust printing energy. Also, heating means are not limited to particular means, and transfer can be carried out using a hot plate, a hot stamper, a heated roll, a line heater, an iron, or the like.

EXAMPLES

The present invention will now be more fully described by means of Examples, whereas this invention is not limited to thereto.

Example 1

As a substrate, a PET film having a thickness of 4.5 μm was prepared.

Subsequently, a releasing layer application liquid having the composition shown below was applied onto a substrate so as to provide 1.0 g/m$^2$ at the dried time to form a releasing layer.

| <A releasing layer application liquid> | |
|---|---|
| A vinyl chloride-vinyl acetate chloride resin (Mw: 35000; manufactured by Nissin Chemical Industry Co., Ltd.; trade designation: SOLBIN ® CNL) | 95 parts by mass |
| A polyester resin (manufactured by Toyobo Co., Ltd.; trade designation: VYLON ® 200) | 5 parts by mass |
| Methyl ethyl ketone | 200 parts by mass |
| Toluene | 200 parts by mass |

Subsequently, a hot melt colored layer application liquid having the composition shown below was applied onto a releasing layer so as to provide 1.0 g/m$^2$ at the dried time to form a hot melt colored layer.

| <A hot melt colored layer application liquid> | |
|---|---|
| A carbon black dispersion (46% solid content; 40% carbon black; 6% dispersant; methyl ethyl ketone/toluene = 1:1) | 100 parts by mass |
| Acrylic resin A (Tg: 105° C.; Mw: 40000; manufactured by Mitsubishi Rayon Co., Ltd.; trade designation: DIANAL ® BR-83) | 40 parts by mass |
| Methyl ethyl ketone | 25 parts by mass |
| Toluene | 25 parts by mass |

A back layer application liquid having the composition shown below was applied onto the surface opposite to the surface of a substrate having a releasing layer formed thereon so as to provide 0.8 g/m$^2$ at the dried time to form a back layer, and thus a transfer sheet was obtained.

| <A back layer application liquid> | |
|---|---|
| A polyvinyl butyral resin (manufactured by Sekisui Chemical Co., Ltd.; trade designation: S-LEC ® BX-1) | 2.0 parts by mass |
| Polyisocyanate (manufactured by Dainippon Ink & Chemicals, Inc.; trade designation: BURNOCK ® D750) | 9.2 parts by mass |
| A phosphate ester-based surfactant (manufactured by Dai-ichi Kogyo Seiyaku Co., Ltd.; trade designation: PLYSURF ® A208N) | 1.3 parts by mass |
| Talc (manufactured by Nippon Talc Co. Ltd.; trade designation: MICRO ACE ® P-3) | 0.3 parts by mass |
| Toluene | 43.6 parts by mass |
| Methyl ethyl ketone | 43.6 parts by mass |

Example 2

Except that acrylic resin A contained in a hot melt colored layer application liquid was changed to acrylic resin B (Tg: 105° C.; Mw: 25000; manufactured by Mitsubishi Rayon Co., Ltd.; trade designation: DIANAL® BR-87), a transfer sheet was obtained as in Example 1.

Example 3

Except that acrylic resin A contained in a hot melt colored layer application liquid was changed to acrylic resin C (Tg: 105° C.; Mw: 85000; manufactured by Mitsubishi Rayon Co., Ltd.; trade designation: DIANAL® BR-52), a transfer sheet was obtained as in Example 1.

Example 4

Except that acrylic resin A contained in a hot melt colored layer application liquid was changed to acrylic resin D (Tg: 90° C.; Mw: 85000; manufactured by Mitsubishi Rayon Co., Ltd.; trade designation: DIANAL® BR-75), a transfer sheet was obtained as in Example 1.

Example 5

Except that acrylic resin A contained in a hot melt colored layer application liquid was changed to acrylic resin E (Tg: 80° C.; Mw: 65000; manufactured by Mitsubishi Rayon Co., Ltd.; trade designation: DIANAL® BR-77), a transfer sheet was obtained as in Example 1.

Example 6

Except that the hot melt colored layer application liquid was changed to those having the composition shown below, a transfer sheet was obtained as in Example 1. It is to be noted that the average Mw of the resin components contained in a hot melt colored layer application liquid was 38000 (40000×0.6+35000×0.4).

| <A hot melt colored layer application liquid> | |
|---|---|
| A carbon black dispersion (46% solid content; 40% carbon black; 6% dispersant; methyl ethyl ketone/toluene = 1:1) | 100 parts by mass |
| Acrylic resin A (Tg: 105° C.; Mw: 40000; manufactured by Mitsubishi Rayon Co., Ltd.; trade designation: DIANAL ® BR-83) | 24 parts by mass |
| A vinyl chloride-vinyl acetate chloride resin (Mw: 35000; manufactured by Nissin Chemical Industry Co., Ltd.; trade designation: SOLBIN ® CNL) | 16 parts by mass |
| Methyl ethyl ketone | 25 parts by mass |
| Toluene | 25 parts by mass |

Reference Example 7

Except that a releasing layer application liquid was changed to those having the composition shown below, a transfer sheet was obtained as in Example 1.

| <A releasing layer application liquid> | |
|---|---|
| A vinyl chloride-vinyl acetate chloride resin (Mw: 35000; manufactured by Nissin Chemical Industry Co., Ltd.; trade designation: SOLBIN ® CNL) | 50 parts by mass |
| Acrylic resin B (Tg: 105° C.; Mw: 25000; manufactured by Mitsubishi Rayon Co., Ltd.; trade designation: DIANAL ® BR-87) | 50 parts by mass |
| Methyl ethyl ketone | 200 parts by mass |
| Toluene | 200 parts by mass |

Reference Example 8

Except that a releasing layer application liquid was changed to those having the composition shown below, a transfer sheet was obtained as in Example 1.

| <A releasing layer application liquid> | |
|---|---|
| Acrylic resin B (Tg: 105° C.; Mw: 25000; manufactured by Mitsubishi Rayon Co., Ltd.; trade designation: DIANAL ® BR-87) | 100 parts by mass |
| Methyl ethyl ketone | 200 parts by mass |
| Toluene | 200 parts by mass |

Example 9

As a substrate, a PET film having a thickness of 4.5 μm comprising a water-dispersible acrylic resin surface-treated for easy adhesion bonding on one surface thereof was prepared. A mold release layer application liquid having the composition shown below was applied onto one surface of this substrate so as to provide 0.5 g/m$^2$ at the dried time to form a mold release layer.

| <A mold release layer application liquid> | |
|---|---|
| A urethane resin | 25 parts by mass |
| An acetal resin (manufactured by Sekisui Chemical Co., Ltd.; trade designation: S-LEC ® KS-5) | 75 parts by mass |
| Toluene | 950 parts by mass |
| Isopropyl alcohol | 950 parts by mass |

Then, a releasing layer application liquid having the composition shown below was applied onto a mold release layer so as to provide 1.0 g/m$^2$ at the dried time to form a releasing layer.

| <A releasing layer application liquid> | |
|---|---|
| A vinyl chloride-vinyl acetate chloride resin (Mw: 35000; manufactured by Nissin Chemical Industry Co., Ltd.; trade designation: SOLBIN ® CNL) | 95 parts by mass |
| A polyester resin (manufactured by Toyobo Co., Ltd.; trade designation: VYLON ® 200) | 5 parts by mass |
| Methyl ethyl ketone | 200 parts by mass |
| Toluene | 200 parts by mass |

Subsequently, a hot melt colored layer application liquid having the composition shown below was applied onto a releasing layer so as to provide 1.0 g/m$^2$ at the dried time to form a hot melt colored layer.

| <A hot melt colored layer application liquid> | |
|---|---|
| A carbon black dispersion (46% solid content; 40% carbon black; 6% dispersant; methyl ethyl ketone/toluene = 1:1) | 100 parts by mass |
| Acrylic resin A (Tg: 105° C.; Mw: 40000; manufactured by Mitsubishi Rayon Co., Ltd.; trade designation: DIANAL ® BR-83) | 40 parts by mass |
| Methyl ethyl ketone | 25 parts by mass |
| Toluene | 25 parts by mass |

A back layer application liquid having the composition shown below was applied onto the surface opposite to the surface of a substrate having a releasing layer formed thereon so as to provide 1.0 g/m$^2$ at the dried time to form a back layer, and thus a transfer sheet was obtained.

| <A back layer application liquid> | |
|---|---|
| A polyvinyl butyral resin (manufactured by Sekisui Chemical Co., Ltd.; trade designation: S-LEC ® BX-1) | 2.0 parts by mass |
| Polyisocyanate (manufactured by Dainippon Ink & Chemicals, Inc.; trade designation: BURNOCK ® D750) | 9.2 parts by mass |
| A phosphate ester-based surfactant (manufactured by Dai-ichi Kogyo Seiyaku Co., Ltd.; trade designation: PLYSURF ® A208N) | 1.3 parts by mass |
| Talc (manufactured by Nippon Talc Co., Ltd.; trade designation: MICRO ACE ® P-3) | 0.3 parts by mass |
| Toluene | 43.6 parts by mass |
| Methyl ethyl ketone | 43.6 parts by mass |

Example 10

Except that a carbon black dispersion contained in a hot melt colored layer application liquid was changed to a titanium oxide dispersion (46% solid content; 40% titanium oxide; 6% dispersant; methyl ethyl ketone/toluene=1:1), a transfer sheet was obtained as in Example 1.

Example 11

Except that a carbon black dispersion contained in a hot melt colored layer application liquid was changed to a yellow pigment dispersion (46% solid content; 40% yellow pigment (Disperse Yellow 54); 6% dispersant; methyl ethyl ketone/toluene=1:1), a transfer sheet was obtained as in Example 1.

Example 12

Except that acrylic resin A contained in a hot melt colored layer application liquid was changed to acrylic resin F (Tg: 105° C.; Mw: 95000; manufactured by Mitsubishi Rayon Co., Ltd.; trade designation: DIANAL® BR-80), a transfer sheet was obtained as in Example 1.

Example 13

Except that acrylic resin A contained in the hot melt colored layer application liquid was changed to a mixture of acrylic resin A and acrylic resin F (mixing ratio: 1:1; average Mw: 67500), a transfer sheet was obtained as in Example 1.

Example 14

Except that acrylic resin A contained in a hot melt colored layer application liquid was changed to a mixture of acrylic resin A and acrylic resin F (mixing ratio: 7:3; average Mw: 56500), a transfer sheet was obtained as in Example 1.

Example 15

Except that the hot melt colored layer application liquid was changed to those having the composition shown below, a transfer sheet was obtained as in Example 1. It is to be noted that the average Mw of the resin components contained in a hot melt colored layer application liquid was 39000.

| <A hot melt colored layer application liquid> | |
|---|---|
| A carbon black dispersion (46% solid content; 40% carbon black; 6% dispersant; methyl ethyl ketone/toluene = 1:1) | 100 parts by mass |
| Acrylic resin A (Tg: 105° C.; Mw: 40000; manufactured by Mitsubishi Rayon Co., Ltd.; trade designation: DIANAL ® BR-83) | 32 parts by mass |
| A vinyl chloride-vinyl acetate chloride resin (Mw: 35000; manufactured by Nissin Chemical Industry Co., Ltd.; trade designation: SOLBIN ® ® CNL) | 8 parts by mass |
| Methyl ethyl ketone | 25 parts by mass |
| Toluene | 25 parts by mass |

Comparative Example 1

Except that acrylic resin A contained in a hot melt colored layer application liquid was changed to a vinyl chloride-vinyl acetate resin (Tg: 70° C.; polymerization degree: 300; manufactured by Nissin Chemical Industry Co., Ltd.; trade designation: SOLBIN® CL), a transfer sheet was obtained as in Example 1.

Comparative Example 2

Except that acrylic resin A contained in a hot melt colored layer application liquid was changed to a vinyl chloride-vinyl acetate resin (Tg: 76° C.; polymerization degree: 200; manufactured by Nissin Chemical Industry Co., Ltd.; trade designation: SOLBIN® CNL), a transfer sheet was obtained as in Example 1.

Comparative Example 3

Except that acrylic resin A contained in a hot melt colored layer application liquid was changed to acrylic resin G (Tg: 55° C.; Mw: 65000; manufactured by Mitsubishi Rayon Co., Ltd.; trade designation: DIANAL® BR-64), a transfer sheet was obtained as in Example 1.

Comparative Example 4

Except that acrylic resin A contained in a hot melt colored layer application liquid was changed to acrylic resin H (Tg: 50° C.; Mw: 45000; manufactured by Mitsubishi Rayon Co., Ltd.; trade designation: DIANAL® BR-116), a transfer sheet was obtained as in Example 1.

[Performance Evaluation of a Transfer Sheet]

The transfer sheets produced in the above-mentioned Examples and Comparative Examples were evaluated for their printing stabilities.

Printing Stabilities

Figure 3:
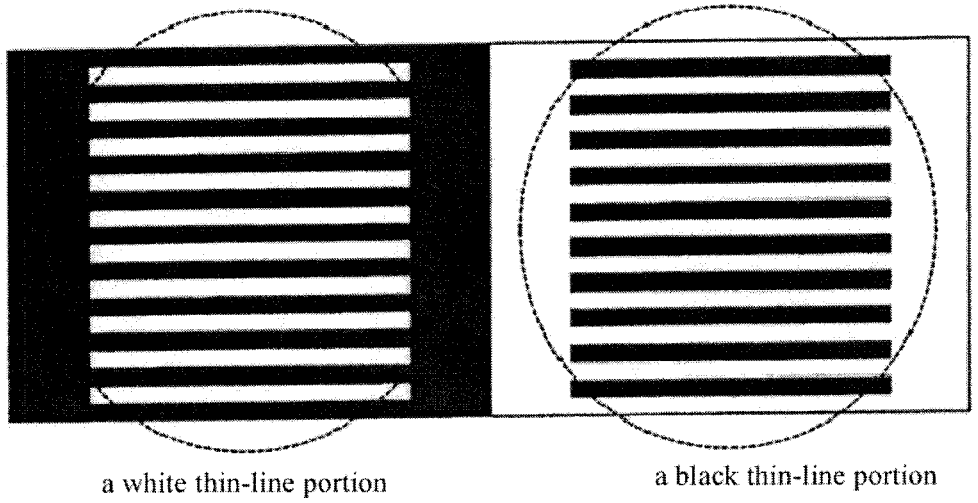
FIG. 3 shows printing patterns (a white line and a black line) of the transfer conditions in evaluating Examples.

Using a transfer sheet prepared in the above-mentioned examples and comparative examples, and a testing printer described below; and with a setting of 3 milliseconds per 1-line period; for each case where print voltages are respectively 16.5 V, 18.0 V and 19.5 V, printing patterns (2 dotted thin lines i.e., printing patterns shown in FIG. 3 at a resolution of 300 dpi) were transcribed onto the receptive layer of an intermediate transfer recording medium prepared as described below. The occurrence of a blur and a crushing of an image was confirmed by visual inspection, and evaluated according to the evaluation criteria below (the better reproducibility of a white thin-line portion is, the less crushings of an image; and the better reproducibility of a black thin-line portion, the less blurs of an image). The evaluation results were summarized in Table 1.

(A Testing Printer)

Thermal head: KEE-57-12GAN2-STA (manufactured by Kyocera Corporation)

Average resistance value of a heating element: 3303 (Ω)

Main scanning direction print density: 300 (dpi)

Sub-scanning direction print density: 300 (dpi)

One-line period: 3.0 (msec.)

Printing start temperature: 35 (° C.)

Pulse-to-duty ratio: 85%

<Preparing an Intermediate Transfer Recording Medium>

A releasing layer application liquid, a protective layer application liquid, and a receptive- and heat-sealing layer application liquid each having respective compositions thereof shown below were sequentially applied onto a PET film having a thickness of 16 μm by gravure reverse coating method and dried to form a releasing layer, a protective layer, and a receptive- and heat-sealing layer; and a transfer body was obtained. The dry coating amounts described above were respectively 1.0 g/m$^2$ for a releasing layer; 2.0 g/m$^2$ for a protective layer; 1.5 g/m$^2$ for a receptive- and heat-sealing layer.

| (A releasing layer application liquid) | |
|---|---|
| Acrylic resin B (Tg: 105° C.; Mw: 25000; manufactured by Mitsubishi Rayon Co., Ltd.; trade designation: DIANAL ® BR-87) | 29 parts by mass |
| A polyester resin (manufactured by Toyobo Co., Ltd.; trade designation: VYLON ® 200) | 1 part by mass |
| Methyl ethyl ketone | 35 parts by mass |
| Toluene | 35 parts by mass |
| (The composition of a protective layer application liquid) | |
| A polyester resin (manufactured by Toyobo Co., Ltd.; trade designation: VYLON ® 200) | 30 parts by mass |
| Methyl ethyl ketone | 35 parts by mass |
| Toluene | 35 parts by mass |
| (a receptive- and heat-sealing layer application liquid) | |
| A vinyl chloride-vinyl acetate chloride resin (Mw: 35000; manufactured by Nissin Chemical Industry Co., Ltd.; trade designation: SOLBIN ® CNL) | 20 parts by mass |
| A silicone oil | 1 part by mass |
| Methyl ethyl ketone | 39.5 parts by mass |
| Toluene | 39.5 parts by mass |

<Blur Evaluation Criteria>

A: No blur, and thus in good condition.

B: Partially blurred, but readable.

C: Difficult to read due to blurs.

D: Overall blur, and thus in bad condition.

<Crushing Evaluation Criteria>

A: No crushing, and thus in good condition.

B: Partially crushed, but readable.

C: Difficult to read due to crushings.

D: Overall crushing, and thus in bad condition.

REFERENCE SIGNS LIST

10 transfer sheet
11 substrate
12 mold release layer
13 releasing layer
14 hot melt colored layer
15 back layer
16 dye layer

The invention claimed is:

1. A transfer sheet comprising a substrate, and a releasing layer and a hot melt colored layer in this order on the substrate:

the hot melt colored layer comprising, as a binder resin, a (meth)acrylic resin having a glass transition temperature of not less than 75° C., and a colorant, wherein the releasing layer comprises a vinyl chloride-vinyl acetate resin, and wherein the content of the vinyl chloride-vinyl acetate resin in the releasing layer is not less than 80% by mass.

2. The transfer sheet according to claim 1, wherein the content of the (meth)acrylic resin in a binder resin of the hot melt colored layer is not less than 50% by mass.

3. The transfer sheet according to claim 2, wherein the weight average molecular weight of the (meth)acrylic resin is 20000 or more and 100000 or less.

4. The transfer sheet according to claim 2, further comprising a mold release layer between the substrate and the releasing layer.

5. The transfer sheet according to claim 2, further comprising a dye layer on the substrate.

6. The transfer sheet according to claim 1, wherein the weight average molecular weight of the (meth)acrylic resin is 20000 or more and 100000 or less.

7. The transfer sheet according to claim 6, further comprising a mold release layer between the substrate and the releasing layer.

TABLE 1

| | Tg (° C.) of an acrylic resin contained in a hot melt colored layer | Mw of an acrylic resin contained in a hot melt colored layer | Printing stability | | | | | |
|---|---|---|---|---|---|---|---|---|
| | | | 16.5 V 3 msec/line | | 18.0 V 3 msec/line | | 19.5 V 3 msec/line | |
| Table 1 | | | Blurs | Crushings | Blurs | Crushings | Blurs | Crushings |
| Example 1 | 105 | 40000 | A | A | A | A | A | A |
| Example 2 | 105 | 25000 | B | A | A | A | A | B |
| Example 3 | 105 | 85000 | A | A | A | A | A | A |
| Example 4 | 90 | 85000 | B | A | A | A | A | B |
| Example 5 | 80 | 65000 | B | A | B | B | A | B |
| Example 6 | 105 | 40000 | C | A | B | B | A | C |
| Reference Example 7 | 105 | 40000 | A | A | A | A | A | A |
| Reference Example 8 | 105 | 40000 | A | A | A | A | A | A |
| Example 9 | 105 | 40000 | A | A | A | A | A | A |
| Example 10 | 105 | 40000 | A | A | A | A | A | A |
| Example 11 | 105 | 40000 | A | A | A | A | A | A |
| Example 12 | 105 | 95000 | A | A | A | A | A | B |
| Example 13 | 105 | 67500 | A | A | A | A | A | A |
| Example 14 | 105 | 56500 | A | A | A | A | A | A |
| Example 15 | 105 | 40000 | B | A | A | A | A | B |
| Comparative Example 1 | — | — | D | B | D | C | A | D |
| Comparative Example 2 | — | — | D | B | C | D | A | D |
| Comparative Example 3 | 55 | 65000 | D | B | C | C | A | D |
| Comparative Example 4 | 50 | 45000 | D | B | C | C | A | D |

8. The transfer sheet according to claim 6, further comprising a dye layer on the substrate.

9. The transfer sheet according to claim 1, further comprising a mold release layer between the substrate and the releasing layer.

10. The transfer sheet according to claim 9, further comprising a dye layer on the substrate.

11. The transfer sheet according to claim 1, further comprising a dye layer on the substrate.

* * * * *